United States Patent [19]

Pittman et al.

[11] 4,149,829

[45] Apr. 17, 1979

[54] GAS LIFT VALVE AND MANDREL COMBINATION WITH IMPROVEMENT OF THE SCREENING FOR SAID VALVE

[75] Inventors: Robert W. Pittman, Sugarland; Noell C. Kerr, Liberty, both of Tex.

[73] Assignee: Texaco Inc., New York, N.Y.

[21] Appl. No.: 883,606

[22] Filed: Mar. 6, 1978

Related U.S. Application Data

[63] Continuation of Ser. No. 745,253, Nov. 26, 1976, abandoned.

[51] Int. Cl.[2] ..... F04F 1/18; E03B 43/18; E21B 43/00

[52] U.S. Cl. ..... 417/109; 166/227; 166/105.1

[58] Field of Search ..... 417/109, 110, 111, 112, 417/113, 114, 115, 116, 117; 166/105.1, 158, 227, 228, 230; 137/545, 155

[56] References Cited

U.S. PATENT DOCUMENTS

| | | | |
|---|---|---|---|
| 1,329,171 | 1/1920 | Garry et al. | 166/105.1 |
| 1,379,477 | 5/1921 | Perry | 166/105.1 |
| 2,405,323 | 8/1946 | Nixon | 137/155 X |
| 3,130,743 | 4/1964 | Canalizo | 417/116 |
| 3,175,514 | 3/1965 | McMurry | 417/117 X |
| 3,678,999 | 7/1972 | Kulikou et al. | 166/227 |

*Primary Examiner*—Carlton R. Croyle
*Attorney, Agent, or Firm*—Thomas H. Whaley; Carl G. Ries; Henry C. Dearborn

[57] ABSTRACT

An improved conventional type of gas lift valve and mandrel combination. It has a large area screen which encloses the valve and prevents it from having the inlet port and/or its integral small area screen, become plugged.

7 Claims, 2 Drawing Figures

GAS LIFT VALVE AND MANDREL COMBINATION WITH IMPROVEMENT OF THE SCREENING FOR SAID VALVE

This is a continuation of application Ser. No. 745,253, filed Nov. 26, 1976, now abondoned.

BACKGROUND OF THE INVENTION

1. Field of the Invention

This invention concerns gas lift operations, in general, and more specifically it deals with an improved structure for use in combination with a conventional gas lift valve and mandrel unit. It provides better protection against plugging of the gas lift valve port.

2. Description of the Prior Art

A conventional type of gas lift valve structure employs a mandrel with gas lift valve mounted thereon. The mandrel is a coupling member that is fastened into a tubing string at some desired location. The structure is such that the gas lift valve has a relatively small sized diameter, and is consequently only provided with a relatively small sized port for accomodating the gas flow when the valve opens. Since the gas which flows through such port is considerable in quantity and is under relatively high pressure, the tendency has been found great for the port to become plugged. Furthermore, even though the conventional arrangement has included a screen element adjacent to the valve port, it has failed to overcome the tendency to plug since the gas flow rate has remained very high and thus has tended to attract and cause to stick any foreign matter that would plug the screen and inactivate the valve.

Furthermore, while there have been some previous structures in connection with wells which dealt with the flow of fluids down hole, these have involved rather complex structures such that the resulting units are quite complex and therefore would be expensive.

Consequently, it is an object of this invention to provide an improved combination of elements that relates to a conventional gas lift valve which is used in combination with a mandrel for mounting the valve in place in a tubing string.

SUMMARY OF THE INVENTION

Briefly, the invention concerns an improvement that relates to a combination with well tubing which has a gas lift valve mandrel coupled therewith. The combination also has a gas lift valve mounted on said mandrel, and the said valve has a relatively small port for admitting gas from the outside into the interior of said tubing during gas lift operations. The improvement comprises means for screening said port to eliminate plugging thereof, which means comprises a relatively large area screen covering the ingress to said port and spaced a substantial distance from said port.

Again briefly, the invention concerns an improvement that relates to a combination with a gas lift valve mandrel adapted for being coupled with well tubing. The said mandrel has an integral lug protruding therefrom for mounting a cylindrical gas lift valve by supporting it from one end thereof, with its axis parallel to the axis of said mandrel. The said valve has a relatively small port for admitting gas from the outside to the interior of said mandrel, and said valve includes an integral screen located adjacent to said port. The improvement comprises a relatively large area screen being semi-cylindrical in shape and enclosing said valve. The said large area screen has one edge sealed against the surface of said lug and the other edges sealed against the surface of said mandrel, all whereby the plugging of said port is prevented by maintaining a low velocity of gas flow through said large area screen.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DESCRIPTION OF THE PREFERRED EMBODIMENT

Figure 1:
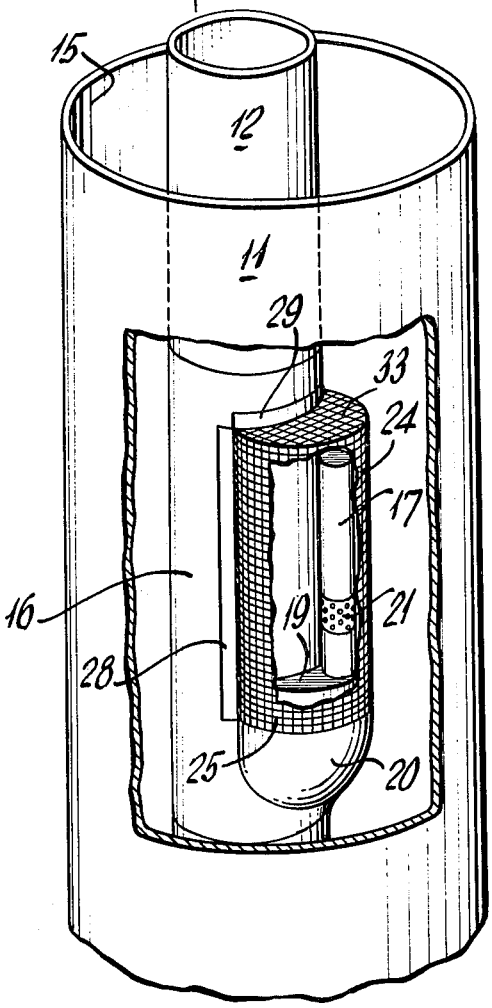
FIG. 1 is a perspective view with a cut-out section in a casing for viewing a mandrel and gas lift valve structure according to the invention.
Figure 2:
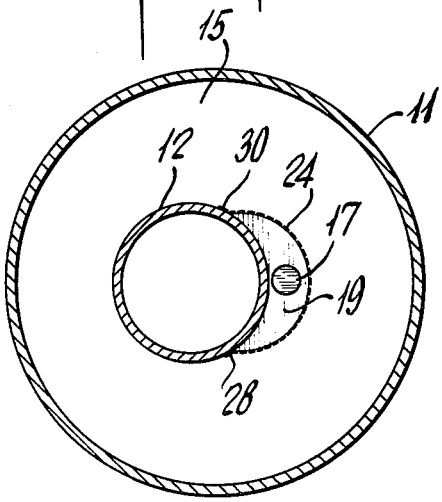
FIG. 2 is a top plan view of the elements illustrated in FIG. 1.

Gas lift operations are often employed in connection with petroleum production and they are usually applicable in areas where sand problems, highly deviated or deep wells, or overwater locations prevent efficient use of sucker rod or submersible pumps. The down-hole equipment for carrying out gas lifting operations is relatively simple. It amounts to a string of small ported valves used to inject pressurized gas from the casing side of vertical tubing into such vertical tubing so as to reduce the density of the fluid sufficiently for flow to occur under the available reservior pressure.

Experience has shown that there is usually some debris in the vertical tubing/casing annulus of a well. This debris tends to consist of particles of packer rubber that is naturally associated with the well operation. In addition, there are also non-associated trash particles that inadvertently are trapped in the annulus of a well. Such debris often becomes entrained by lift-gas and so is sucked into the port of one or more of the gas lift valves. Consequently, it clogs such valves making them inoperable. Also, experience has shown that in about one-quarter of the situations where inproper operation of a gas lift system has been found, the problem was directly related to debris clogged valve ports. Correction of the problem results in additional reworking expense on the hole, and also a loss of production therefrom.

The manufacturers of gas lift valves have attempted to deal with the problem of plugging. But, the relatively small area of screens that have been devised to cover the ports of the gas lift valves, have not changed the situation for the better. This has been because they (i.e. the screens) have also been subject to being plugged by debris in an equivalent manner as the ports. However, the applicants invention has conceived of a different approach, and thus has provided a structure that will substantially eliminate the plugging problem for gas lift valves of a conventional type.

Referring to the figures of the drawings, it is pointed out that the invention involves a conventional type of gas lift valve, as mounted on a mandrel that is coupled into the tubing in a well. Such tubing is located inside of casing for the well so that there is an annulus which contains the gas under pressure that is employed in a gas lift operation.

It will be understood that most gas lift operations will involve a substantial plurality of gas lift valves spaced vertically along a tubing string in the well. However, the concept of this invention is clearly illustrated in connection with a single gas lift valve and mandrel combination.

With specific reference to the figures of the drawings, there is illustrated a casing 11 that surrounds a tubing string 12 which extends down inside of the casing 11 forming an annulus 15 therebetween. These elements are, of course, conventional. Also, in connection with a gas lift procedure, there is a gas lift mandrel 16 that is coupled into the well string 12. It will be understood from the foregoing that there may be a number of these mandrels spaced along the tubing string down hole at desired locations there along. Each such mandrel 16 has a gas lift valve 17 mounted thereon.

It may be noted again that the mandrel 16 and accompanying gas lift valve 17 are conventional equipment that may take somewhat different form from that illustrated, in different instances. However, this invention is particularly applicable to a type of mandrel that is illustrated. It has the gas lift valve 17 mounted outside of the mandrel 16 and with its axis lying substantially parallel to the axis of the mandrel.

As indicated in the drawings, the mandrel 16 has an integral lug 20 that protudes therefrom, and that has structure, e.g. a threaded hole in a flat surface 19, for supporting the gas lift valve 17. The internal arrangement (not shown) is such that the gas flow from the annulus 15 may go in through the valve 17 when it opens and enter the inside of the mandrel 16. Consequently, it goes to the inside of the tubing string 12. The interior passages for accomplishing this gas flow are not specifically illustrated since they are conventional and not relevant to the invention.

It may be noted that it is also conventional for the gas lift valve 17 to have a small integrally mounted screen 21 that covers the inlet port (not shown) of the valve 17. It will be understood that this screen 21 is is of necessity quite close to the port structure of the valve 17. Consequently, the velocity of gas flow through the screen 21 is substantially the same as the velocity through the port structure, which is quite substantial as was indicated above.

There is a semi-cylindrical screen 24 that encloses the valve 17. A lower edge 25 as viewed in FIG. 1, of the screen 24, is sealed against the surface of the lug 20. It may noted that the semi-cylindrical shape of the screen 24 is formed by its conforming with the surface of the lug 20. However, remaining edges 28 and 29, as well as an edge 30 (that is not in sight in FIG. 1) will also be fastened down and sealed to the surface of the mandrel 16.

It will be appreciated that the sealing of the edges 25, 28, 29 and 30 may be carried out in any feasible manner, e.g. by employing flanges. Of course, they may be fastened down with machine screws (not shown) or the like. It will also be appreciated that a top surface 33, of the screen 24, may be formed in any feasible manner, such as by shaping the screen as it is mounted.

It will be noted that the exposed area of the large screen 24 is very substantial. Consequently, and by reason of its displacement some distance away from the gas lift valve 17, the velocity of flow of the gas through the screen 24 will be quite low. Therefore there will be substantially no force tending to clog the passages through the screen, as any debris comes in contact or might tend to collect thereon.

While a particular embodiment of the invention has been described above in considerable detail in accordance with the applicable statutes, this is not to be taken as in any way limiting the invention but merely as being descriptive thereof.

We claim:

1. In combination with well tubing adapted for mounting inside of casing in a well during gas lift operations, said tubing having a gas lift valve mandrel coupled therewith, said tubing and mandrel with said casing forming an annulus therebetween inside said well, a gas lift valve mounted on said mandrel, said valve having a port for admitting gas from the outside into the interior of said tubing during gas lift operations, the improvement comprising means for screening said port to eliminate plugging thereof, comprising a screen having a very substantial exposed area and completely covering the ingress to said port, said screen being located in said annulus and being spaced a substantial radial distance from said valve whereby to reduce the velocity of said gas flow through said screen.

2. The invention according to claim 1, wherein said gas lift valve is mounted on the exterior of said mandrel, and said large area screen encloses said gas lift valve.

3. The invention according to claim 2, wherein said gas lift valve includes an integral screen located adjacent to said port.

4. The invention according to claim 3 wherein said mandrel has a lug integral therewith for mounting said gas lift valve thereon, and said large area screen has one edge sealed against the surface of said lug.

5. The invention according to claim 4, wherein said gas lift valve is cylindrical and is mounted with its axis parallel to the axis of said mandrel.

6. The invention according to claim 5, wherein said large area screen has the other edges sealed against the exterior of said mandrel.

7. In combination with a gas lift valve mandrel coupled with well tubing and mounted inside of a casing in a well during gas lift operations, said tubing and mandrel with said casing forming an annulus therebetween inside said well, said mandrel having an integral lug protruding therefrom for mounting a cylindrical gas lift valve by supporting it from one end thereof with its axis parallel to the axis of said mandrel, said valve having a port for admitting gas from the outside into the interior of said mandrel, and said valve including a first integral screen located adjacent to said port, the improvement comprising a large exposed area second screen completely covering said valve and having one edge sealed against the surface of said lug and the other edges sealed against the outer surface of said mandrel, said second screen being located in said annulus and being spaced radially a substantial distance from said valve, whereby the plugging of said port is prevented by maintaining a low velocity of gas flow through said large area second screen.

* * * * *